US007350241B2

(12) United States Patent
Gendall

(10) Patent No.: US 7,350,241 B2
(45) Date of Patent: Apr. 1, 2008

(54) QUICK ADJUSTMENT BANDANA DEVICE

(76) Inventor: Alex K. Gendall, 922 Lucile Ave., Los Angeles, CA (US) 91101

( * ) Notice: Subject to any disclaimer, the term of this patent is extended or adjusted under 35 U.S.C. 154(b) by 0 days.

(21) Appl. No.: 10/826,839

(22) Filed: Apr. 19, 2004

(65) Prior Publication Data

US 2005/0229291 A1 Oct. 20, 2005

(51) Int. Cl.
*A42B 1/18* (2006.01)

(52) U.S. Cl. ..... 2/206; 2/207; 2/173; 2/9

(58) Field of Classification Search ..... 2/9, 2/173, 206, 207, 468
See application file for complete search history.

(56) References Cited

U.S. PATENT DOCUMENTS 3,105,970 A * 10/1963 Herzberg ..... 2/91
4,853,974 A 8/1989 Olim
5,035,006 A 7/1991 Hetz et al.
5,575,009 A * 11/1996 Ryvin ..... 2/173
5,685,016 A 11/1997 Douglas
6,032,292 A * 3/2000 Wood et al. ..... 2/207
6,247,181 B1 6/2001 Hirsch et al.
D458,004 S * 6/2002 Magdziak-Hautala ..... D2/500
6,523,182 B1 2/2003 Brawner
2004/0078869 A1* 4/2004 Bell et al. ..... 2/206

* cited by examiner

*Primary Examiner*—Katherine Moran
*Assistant Examiner*—Richale L Haney Quinn
(74) *Attorney, Agent, or Firm*—William W. Haefliger

(57) ABSTRACT

A bandana device for use by a vehicle rider wearing a helmet, to protect against dust impingement on the face, whereby when the bandana is applied to the wearer's face and the corners are brought together at the rear of the wearer's neck and below the lowermost rear edge of the helmet, the components are then positioned to be pressed together to retain the bandana tensioned over the wearer's face, and to exclude entrance of dust and dirt beneath the bandana.

2 Claims, 3 Drawing Sheets

QUICK ADJUSTMENT BANDANA DEVICE

BACKGROUND OF THE INVENTION

This invention relates generally to face protecting bandanas, for use by riders of vehicles exposed to dust and dirt, and more particularly to an easily applied bandana quickly adjustable relative to a helmet worn by the riders, for example a motorcyclist.

Vehicle riders whose faces are exposed to on-coming dust and dirt are in need of protection against impact and build-up of such dust and dirt. Also they are in need of face protecting means that is easily and quickly applied and adjusted, for example relative to a helmet which interferes with adjustment of such a protective device. There is need for a face protective device which is comfortable to wear, easily and quickly applied, and readily adjusted, with or without a helmet on.

SUMMARY OF THE INVENTION

It is a major object of the invention to provide an improved face protecting bandana device having a construction and operation that meets the above needs, exceptionally well. Basically, the bandana device comprises:

a) a generally triangular flexible protective fabric having two upper corners, with opposite sides, b) each upper corner defining an upper horizontal edge and a side edge extending generally normal to said upper edge, c) press-together connection components attached to the bandana, at said corners, one component on one side of the bandana, and another component on the opposite side of the bandana, said components extending proximate said edges, d) whereby when the bandana is applied to the wearer's face and said corners are brought together at the rear of the wearer's neck and below the lowermost rear edge of the helmet, said components are then positioned to be pressed together to retain the bandana tensioned over the wearer's face.

Another object is to provide the above device wherein one component carries hook elements and the other component carries pile elements to connect to said hook elements when pressed together. Dangling pointed ends of the bandana are avoided.

Another object is to provide the above device that has thickened zones proximate said corners, there being a first base supporting said hook elements, and a second base supporting said pile elements, the first base attached to one of said bandana thickened zones, and the second base attached to the other of said bandana thickened zones. As will be seen, one of the components may typically have face area $A_1$ and the other of said components has face area $A_2$, where $$A_1 >> A_2$$

allowing for tightening or loosening adjustment of the bandana, via the press-together components by shifting of the position of $A_1$ relative to $A_2$, and which can be determined without visibility, by finger engagement with bandana edges near $A_1$ and $A_2$.

A further object includes provision of the above device wherein said thickened zones have overall thickness equal to at least two layers of the bandana fabric. As will be seen, the thickened zones have special advantage when overall thickness is equal to four layers of the bandana fabric. Further in this regard, the bandana may have foldable triangular upper corner sections forming said corners, to provide thickening as referred to, and generally rectangular upper corners, with upper and side edges as defined, both of these features benefiting positioning and support of the hook and pile elements as well as their use and adjustment functioning.

Yet another object is to provide resiliently yieldable or stretchable means attaching at least one of said components to the bandana, whereby the pressed together components may shift position, resiliently, relative to at least one of the bandana corners, when the bandana is tensioned over the wearer's face.

The bandana complements the wearing and functioning of a protective helmet by the user, since on-coming dust and dirt swirling into the helmet at or proximate its lower edges cannot reach the face and neck of the rider, which is covered by the quickly adjustable bandana held tightly to the face and neck by the bandana quickly adjusted or adjustable to be tightened by the wearer, as with one hand, as by adjusting the relative positions of the hook and pile components, relative to said helmet lower edges.

These and other objects and advantages of the invention, as well as the details of an illustrative embodiment, will be more fully understood from the following specification and drawings, in which:

DRAWING DESCRIPTION

DRAWING DESCRIPTION

Figure 5:
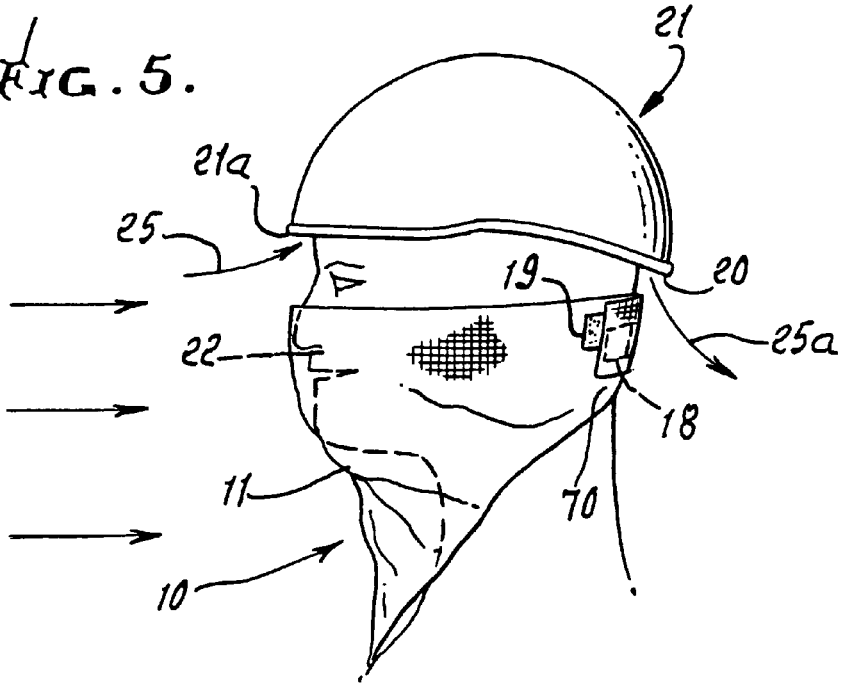
FIG. 5 is an elevation showing use of the device on the face and neck of a vehicle rider wearing a helmet.
Figure 6:
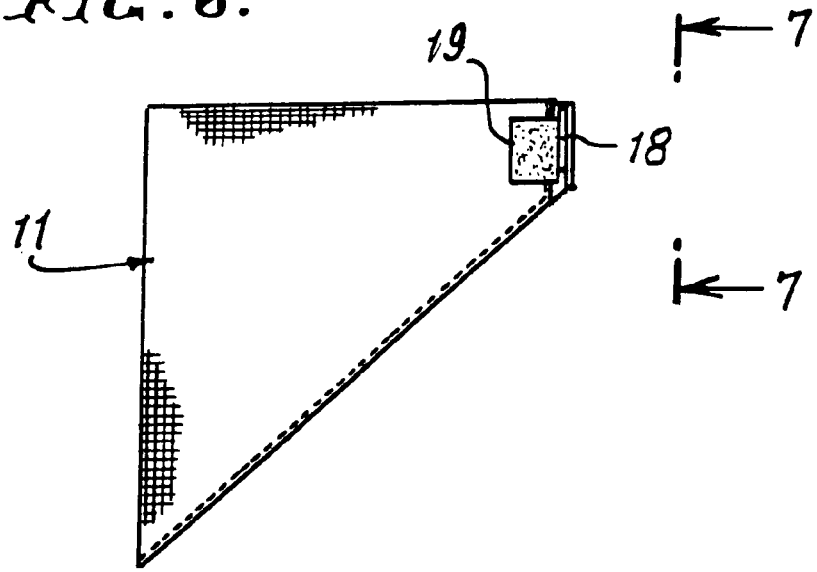
FIG. 6 is a side elevation showing attachment of bandana device corner positions.
Figure 7:
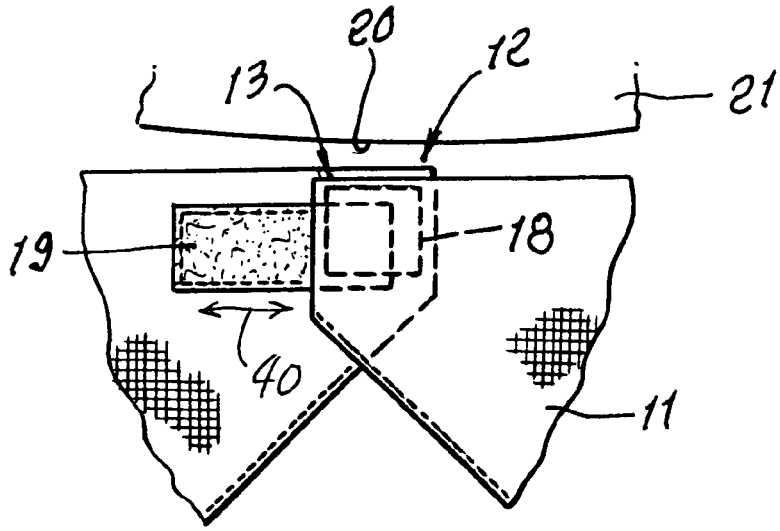
FIG. 7 is an elevation taken on lines 7-7 of FIG. 6.

The drawings show the preferred bandana device 10 having the following:

a) a generally triangular flexible protective fabric 11 having two upper corners 12 and 13, with opposite sides, 14 and 15, and 14*a* and 15*a*, b) the upper corners defining upper horizontal edges 16 and 16*a* and side edges 17 and 17*a* extending generally normal to said upper edges, c) press-together connection components 18 and 19 attached to the bandana, at said corners, one component on one side of the bandana, and another component on the opposite side of the bandana, said components extending proximate said edges, d) whereby when the bandana is applied to the wearer's face and said corners are brought together at the rear of the wearer's neck 70 and just below the lowermost rear edge 20 of the helmet 21, as seen in FIG. 7, said components are then positioned to be pressed together to retain the bandana tensioned over the wearer's face 22 after position adjustment (see FIG. 5).

As shown, one of the components 18 and 19 may preferably include hook elements, and the other component may include pile elements, to interconnect when easily pushed together at the rear of the wearer's neck. This obviates need to tie the bandana corners 12 and 13, and includes ease of adjustment by reaching back to adjust the positions of 18 and 19 while the rider is wearing a helmet, for example. Such adjustment ensures exclusion of dust and dirt particles from entering beneath the bandana particularly at the squared off corner regions 12 and 13, held together. See the arrows 25 in FIG. 5 showing path of dust and dirt flow under the helmet forward edge 21*a* and circulating rearwardly in the helmet to flow downwardly at 25*a* toward the bandana corners 12 and 13 held together by 18 and 19 against the wearer's rear neck region.

Figure 1:
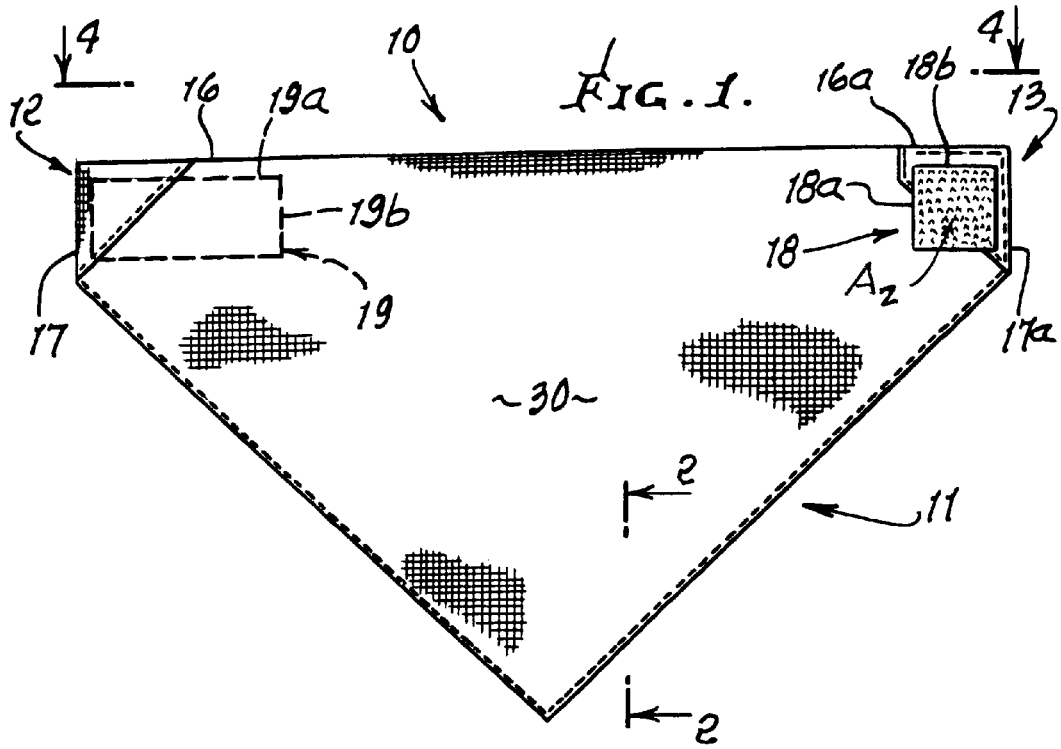
FIG. 1 is a front elevation showing a preferred bandana device incorporating the invention.
Figure 2:
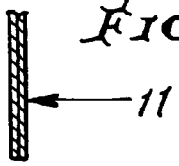
FIG. 2 is a section taken on lines 2-2 of FIG. 1.
Figure 4:
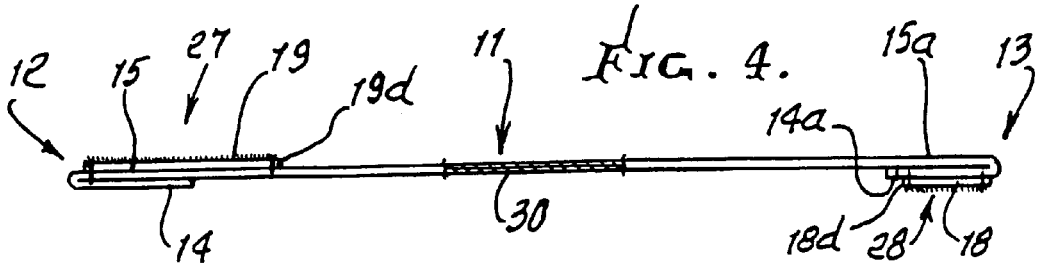
FIG. 4 is a view taken on lines 4-4 of FIG. 1.
Figure 3:
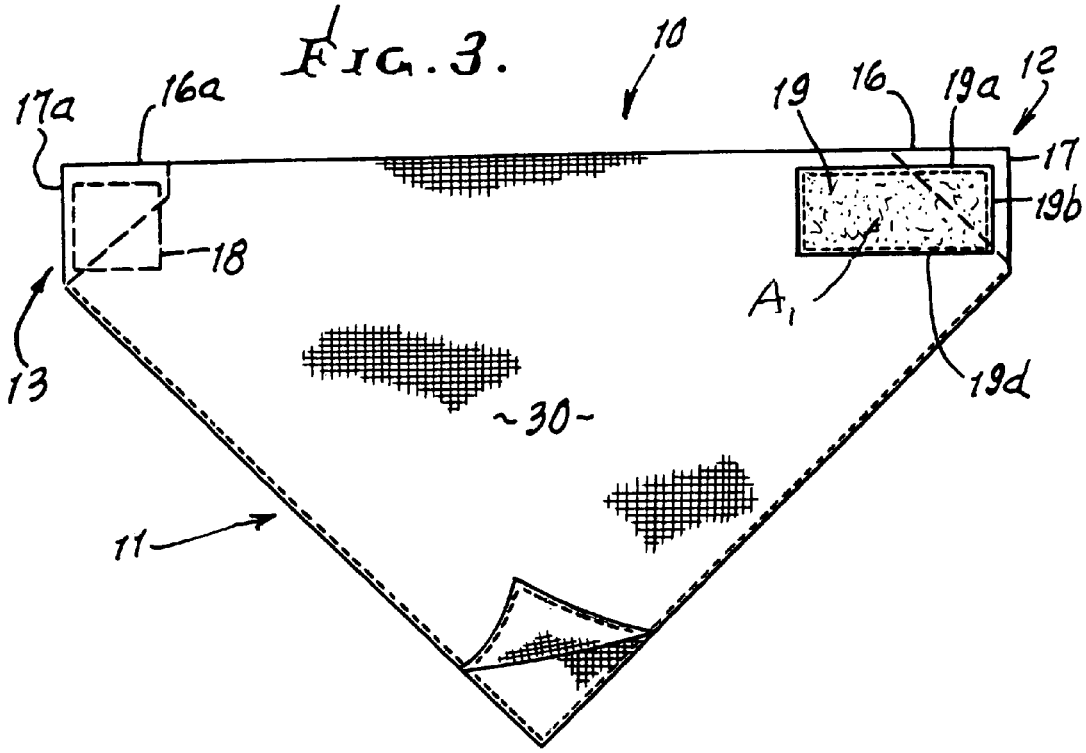
FIG. 3 is a rear elevation view of the FIG. 1 device.

FIG. 4 shows that the bandana has thickened zones 27 and 28 formed by folding back the bandana corner material or layers and stitching them in position, and also to form the side edges 17 and 17*a* that extend generally perpendicularly relative to upper edges 16 and 16*b*. Such edges orient the user's fingers to enable accurate push together of the hook and pile regions 18 and 19, without viewing them, at the neck rear. Edges 18*a* and 18*b* of 18 are generally parallel to 16*a* and 17*a* respectively, and edges 19*a* and 19*b* of 19 are generally parallel to 16 and 17.

A first base of support material 18*d* carries 18 and is stitched to the folded corner 13 of the bandana, and a second base of support material 19*d* carries 19, and is stitched to the folded corner 12 of the bandana. The thickened zones are four layers thick, due to the main area 30 of the bandana having double thickness.

It will be noted that component 19 has face area $A_1$, and the other component 18 has face area $A_2$, where $A_1 >> A_2$. This allows for tightening or loosening adjustment of the bandana, as via the press-together components by shifting of the position of $A_1$ relative to $A_2$, in directions 40, seen in FIG. 7.

Figure 8:
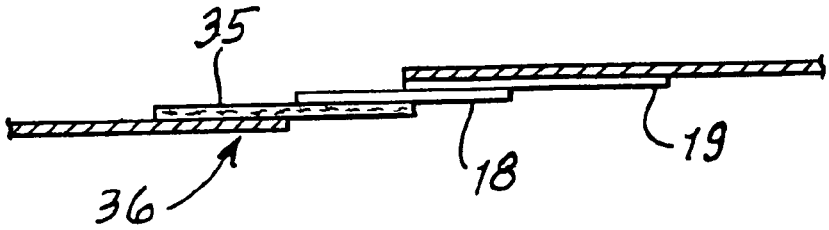
FIG. 8 is a schematic view showing use of a resiliently stretchable device in relation to press-together attachment components.

FIG. 8 shows provision for resilient stretchability of the tightened bandana. A layer 35 of elastic material is attached between a bandana corner 36 and one of the attached components, such as 18. This allows for stretching of the connection at the wearer's rear neck region, for improved retention of the bandana to the wearer's face, and exclusion of dust and dirt, at neck region 70.

I claim:

1. A bandana device for use by a vehicle rider wearing a helmet, to protect against dust impingement on the face, consisting of, in combination:

a) a generally triangular flexible protective fabric having two upper corners, with opposite sides, b) each upper corner defining an upper horizontal edge and a side edge extending generally normal to said upper edge, c) press-together connection components attached to the bandana, at said corners, one component on one side of the bandana, and another component on the opposite side of the bandana, said components extending proximate said edges, d) whereby when the bandana is applied to the wearer's face and said corners are brought together at the rear of the wearer's neck and below the lowermost rear edge of the helmet, said components are then positioned to be pressed together to retain the bandana tensioned over the wearer's face, and to exclude entrance of dust and dirt under the bandana, e) the components respectively having face area $A_1$ and face area $A_2$, where $$A_1 >> A_2$$

allowing for tightening or loosening adjustment of the bandana, via the press-together components by shifting of the position of $A_1$ relative to $A_2$, f) and wherein one component carries hook elements and the other component carries pile elements to connect to said hook elements when pressed together, g) and wherein the bandana has two folded generally triangular upper corner sections of generally the same size forming said corners, one section at one side face of the bandana and the other section at the opposite side face of the bandana, the corner sections each defining an angled edge forming a leg of the corner section triangle, h) each said folded corner section forming four layers of said fabric, said components stitched to said respective corner sections, said components each having rectangular face area outline, one substantially smaller than the other, and wherein the components respectively widthwise directly overlap major length extents of said angled edges defined by the respective corner sections, at opposite sides of the bandana, i) and including resiliently yieldable means attaching at least one of said components to the bandana, whereby the pressed together components may shift position, resiliently, relative to at least one of the bandana corners, when the bandana is tensioned over the wearer's face.

2. The combination of claim 1 including said helmet having its lower rear edge proximate but above said pressed together components.

* * * * *